US005835831A

United States Patent [19]

Staudenmayer et al.

[11] Patent Number: 5,835,831

[45] Date of Patent: Nov. 10, 1998

[54] REPRODUCTION APPARATUS IMAGE TRANSFER CONTROL FOR PREVENTING FUSER OIL CONTAMINATION DEFECTS

[75] Inventors: William J. Staudenmayer, Pittsford; Rodney R. Bucks, Webster, both of N.Y.

[73] Assignee: Eastman Kodak Company, Rochester, N.Y.

[21] Appl. No.: 847,440

[22] Filed: Apr. 28, 1997

[51] Int. Cl.[6] ..... G03G 15/16

[52] U.S. Cl. ..... 399/308; 399/309

[58] Field of Search ..... 399/297, 298, 399/301, 302, 308, 309

[56] References Cited

U.S. PATENT DOCUMENTS

| | | | |
|---|---|---|---|
| 5,040,026 | 8/1991 | Jamzadeh et al. | 399/301 |
| 5,070,369 | 12/1991 | Mahoney et al. | 399/309 X |
| 5,512,986 | 4/1996 | Toyomura et al. | 399/308 X |
| 5,619,746 | 4/1997 | Kubo et al. | 399/297 |

*Primary Examiner*—Arthur T. Grimley
*Assistant Examiner*—Hoan Tran
*Attorney, Agent, or Firm*—Lawrence P. Kessler

[57] ABSTRACT

In an electrostatographic reproduction apparatus capable of producing duplex copies, an intermediate transfer member is utilized for transferring a marking particle image from a member upon which such marking particle image is initially formed to the intermediate transfer member and thereafter from the intermediate transfer member to a receiver member. A fuser assembly, dispensing fuser oil to prevent offset of a marking particle image to the fuser assembly, is then utilized for fixing a transferred image on the receiver member. In order to prevent fuser oil contamination defects on copies produced by such reproduction apparatus, the intermediate transfer member and the member upon which a marking particle image is initially formed are rotated in timed relation to effect registered transfer of such marking particle image from the member to the intermediate transfer member during a print cycle. The starting point for marking particle image formation on the member upon which a marking particle image is initially formed, and thus the starting point for transfer to the intermediate transfer member for successive print cycles is adjusted, whereby the starting point for successive print cycles precesses along the surface of the intermediate transfer member.

9 Claims, 2 Drawing Sheets

REPRODUCTION APPARATUS IMAGE TRANSFER CONTROL FOR PREVENTING FUSER OIL CONTAMINATION DEFECTS

BACKGROUND OF THE INVENTION

The present invention relates in general to image transfer in reproduction apparatus such as copiers or printers or the like, and more particularly to reproduction apparatus image transfer control for preventing contamination defects on copies produced by such reproduction apparatus that are fuser oil related.

In typical commercial electro-statographic reproduction apparatus (copier/duplicators, printers, or the like), a latent image charge pattern corresponding to information to be reproduced is formed on a uniformly charged charge-retentive or photo-conductive member having dielectric characteristics (hereinafter referred to as the dielectric member). Pigmented marking particles are attracted to the latent image charge pattern to develop such image on the dielectric member. A receiver member is then brought into contact with the dielectric member, and an electric field applied to transfer the marking particle developed image to the receiver member from the dielectric member. After transfer, the receiver member bearing the transferred image is transported away from the dielectric member, and the image is fixed (fused) to the receiver member by heat and pressure to form a permanent reproduction thereon.

In certain electrostatographic reproduction apparatus, it has been suggested that image transfer be accomplished by use of intermediates. That is, a marking particle image is formed on a dielectric member and is transferred to an intermediate roller or web. The marking particle image is then transferred from the intermediate member to a receiver member. The transferred image is then fixed to the receiver member by heat and/or pressure. The use of intermediate transfer can simplify receiver sheet handling, or enable accomplishment of single pass duplex copying. It has been shown to reduce wear of the dielectric member, and can facilitate laying down of superimposed marking particle images.

For multi-color information reproduction, a series of color separation marking particle images are formed on a dielectric member and are sequentially transferred in superimposed register to an intermediate roller or web. The marking particle images are then transferred as one from the intermediate member to a receiver member. The receiver member, in either instance, may be inverted and returned (recirculated) to the intermediate member to receive a subsequent marking particle image on the opposite side of the receiver member to form a duplex copy.

It is well known that in certain electrostatographic reproduction apparatus, where offset preventing fuser oil is utilized to reduce offset artifacts on receiver members, the receiver members tend to each acquire some amount of the offset preventing fuser oil as the marking particle image is fixed thereto. Then, when reproducing duplex copies, the fuser oil is carried by the recirculating receiver member into contact with the transfer roller and the intermediate transfer member. This allows some of the fuser oil to contaminate the transfer roller, the intermediate transfer member, and the dielectric member. The contaminate fuser oil associated with the transfer roller, the intermediate transfer member, or the dielectric member may interfere with the proper function of the electrographic process and cause defects on the reproduced copies. This is particularly true when the intermediate transfer member contacts the transfer roller directly with no receiver member lying therebetween; that is, during the time between image transfers to sequential receiver members.

SUMMARY OF THE INVENTION

In view of the foregoing discussion, this invention is directed to reproduction apparatus image transfer control for preventing contamination defects on copies produced by such reproduction apparatus that are fuser oil related. In certain type of electrostatographic reproduction apparatus capable of producing duplex copies, an intermediate transfer member is utilized for transferring a marking particle image from a member upon which such marking particle image is initially formed to the intermediate transfer member and thereafter from the intermediate transfer member to a receiver member. A fuser assembly, including means for dispensing fuser oil to prevent offset of a marking particle image to the fuser assembly, is then utilized for fixing a transferred image on the receiver member. In order to prevent fuser oil contamination defects on copies produced by such reproduction apparatus, the intermediate transfer member and the member upon which a marking particle image is initially formed are rotated in timed relation to effect registered transfer of such marking particle image from the member to the intermediate transfer member during a print cycle. The starting point for marking particle image formation on the member upon which a marking particle image is initially formed, and thus the starting point for transfer to the intermediate transfer member for successive print cycles is adjusted, whereby the starting point for successive print cycles precesses along the surface of the intermediate transfer member.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
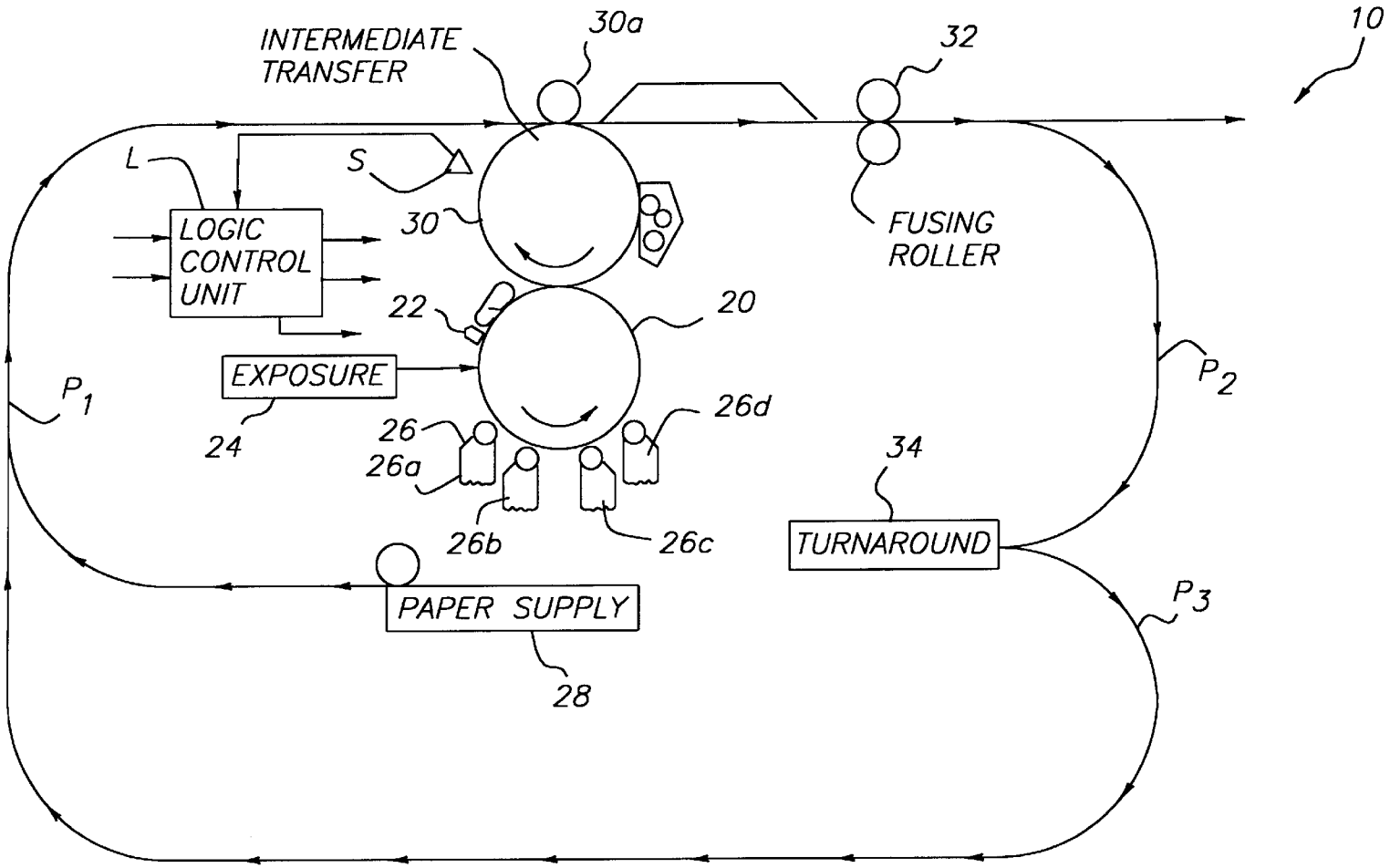
FIG. 1 is a schematic illustration of a reproduction apparatus capable of employing the image transfer control for preventing fuser oil contamination defects on copies produced by such reproduction apparatus.

Referring now to the accompanying drawings, FIG. 1 shows a representative electrophotographic reproduction apparatus, designated generally by the numeral 10. With the particular arrangement of the reproduction apparatus 10, it is possible to produce duplex copies. Specifically, under the operative control of any suitable well known microprocessor-based logic and control unit L, a charge-retentive or photoconductive member having dielectric characteristics (hereinafter referred to as the dielectric member 20), moved along a path in operative relation to electrographic process stations, is uniformly charged by any well known charging device 22 (e.g., a corona charger). A latent image charge pattern, corresponding to information to be reproduced, is formed by altering the uniform charge on the dielectric member 20 by exposing the dielectric member to a light pattern generated by an exposure apparatus 24, such as an LED print head or laser device for example.

Pigmented marking particles from a development station 26 are attracted to the latent image charge pattern to develop such latent image on the dielectric member 20. The developed marking particle image formed on the moving dielectric member 20 is transferred in an electrostatic field to a continuous surface intermediate transfer member, such as drum 30, moving in timed relation with the dielectric member. Also suitable for use with this invention, the intermediate transfer member may alternatively include an endless web mounted for movement about a closed loop path in operative association with the dielectric member. The developed marking particle image is then transferred in an electrostatic field from the intermediate transfer drum 30 to a receiver member, transported along path $P_1$, from a sheet supply 28, into contact with the intermediate transfer drum. An electric field is applied to effect transfer of the marking particle developed image to the receiver member from the intermediate transfer drum. After transfer, the receiver member bearing the transferred image is transported through a fuser assembly 32, where the transferred marking particle image is fixed to the receiver member by heat and pressure to form a permanent reproduction thereon.

If it is desired to make reproductions of multi-color information, a series of latent color separation images of, for example, multi-color information to be copied is formed on the dielectric member 20. The color separation latent images of the series are developed with different color marking particles respectively from a plurality of developing devices 26*a*–26*d* of the development station 26. The formed color separation marking particle images are then sequentially transferred in superimposed register to the intermediate roller 30. The composite marking particle image formed from the superimposed images is then transferred (as one) from the intermediate roller to a receiver member transported along the path $P_1$. After the composite image is transferred from the intermediate roller to the receiver member, the composite image is fused to the receiver member to complete the color information reproduction.

In either monochrome or multi-color information reproduction, the receiver member may be inverted and returned to the intermediate transfer drum 30 to have a subsequent marking particle image transferred to the opposite side of the receiver member to form the duplex copy. That is, the receiver member may be diverted from path $P_1$ and transported along the path $P_2$ to a turnaround device 34 where the receiver member is inverted. The inverted receiver member is then transported along the path $P_3$ where it is returned to the path $P_1$ for recirculation through the transfer nip. Since it is well known that receiver member materials, such as paper, absorb fuser oil, it can be appreciated that a receiver member that has passed through the fuser 32 has acquired some amount of fuser oil. When the fused receiver member is recirculated and transported between a transfer backup roller 30*a* and the intermediate transfer drum 30 to form the duplex reproduction, some fuser oil may be transferred by the receiver member to the transfer roller and/or the intermediate transfer drum (and subsequently to the dielectric member 20) to contaminate these elements. This is a particular problem in regions of the intermediate transfer drum 30 which overlie the interframes between subsequent receiver members (i.e., successive print cycles). Such regions only contact the transfer roller 30*a* during the normal operation of the reproduction apparatus 10, and are never contacted by the receiver member. This may subsequently interfere with the proper function of the electrophotographic process.

Figure 2:
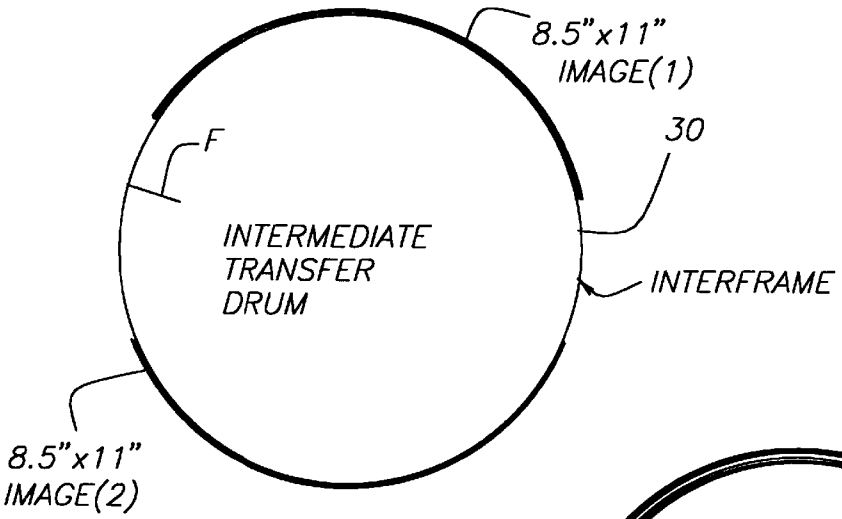
FIG. 2 is a schematic illustration of an intermediate transfer drum for the reproduction apparatus of FIG. 1, showing the interframe location between consecutive images, formed on the intermediate transfer drum, of a cumulative dimension less than the circumference of the intermediate transfer drum.

As an illustrative example, with the reproduction apparatus 10 including an intermediate transfer drum 30 having a 6" diameter, it would be quite common to have a region of such intermediate transfer drum that did not contact the receiver member for the reproduction of information onto 8.5"×11" receiver members. That is, images to be copied onto 8.5"×11" receiver members will fit around the circumference of the intermediate transfer drum 30, with an interframe region upstream of the lead edge of each image (see FIG. 2). If a single "start-of-image" location is used to signal the logic and control unit L of the reproduction apparatus to start the processing of an image for a print cycle, the position of this interframe would be in a fixed location with respect to the circumference of the intermediate transfer drum for each print cycle. The "start-of-image" location is commonly determined by a single flag F that is attached to the intermediate transfer drum 30, and detected by any appropriate sensor S of the reproduction apparatus. Because the flag F is physically attached to the intermediate transfer drum 30, and because it is used to initiate the imaging process, the interframe between two 8.5"×11" images will always be in the same location with respect to the circumference of the intermediate transfer drum relative to the flag F.

Figure 3:
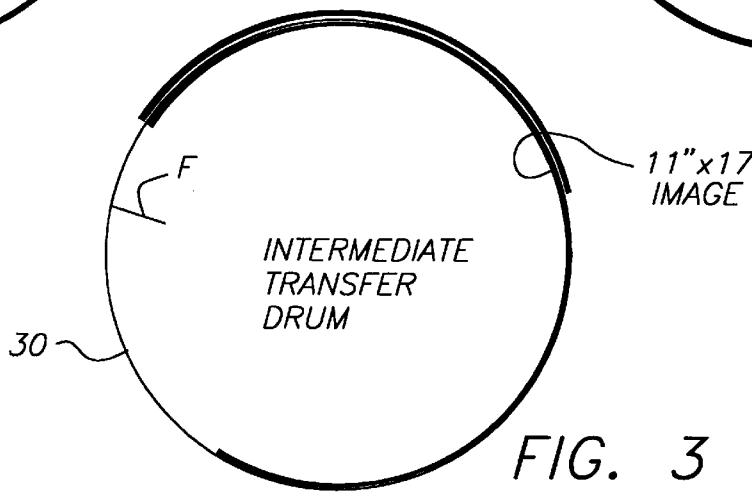
FIG. 3 a schematic illustration of an intermediate transfer drum for the reproduction apparatus of FIG. 1, showing the interframe location between consecutive images, formed on the intermediate transfer drum, as shown in FIG. 2, with respect to an image of a dimension greater than either of the respective images of FIG. 2.

On the other hand, when an image to be copied to an 11"×17" receiver member follows a number of reproductions made from images copied to 8.5"×11" receiver members, the electrophotographic process may respond to the area of the intermediate transfer drum previously defining the interframe area between the images differently than the region that had actually come in contact with the receiver members. That is, in the region defining the interframe between the 8.5"×11" receiver members which is thereafter used to reproduce an image to be copied to an 11"×17" receiver member, a band of increased background can be caused to appear in that region due to the contamination resulting from fusing oil directly contacting the intermediate transfer drum (see FIG. 3).

It has however been shown that typical paper receiver members appear to be effective at soaking up fuser oil on the transfer roller 30*a* and the intermediate transfer drum 30, and removing such contaminating fuser oil from the transfer system. According to this invention, the logic and control unit L causes the lead edge of an image formed at the start of a print cycle to be made to move with relation to the circumference of the intermediate transfer drum. Thus, the interframe region will not be located in the same position for each print cycle, but rather will precess about the circumference of the intermediate transfer drum. This substantially eliminates the buildup of fuser oil contamination in the region corresponding to the interframe between images, and cause the entire circumference of the intermediate transfer drum to be contact by fuser oil absorbing receiver members upon completion of a predetermined number of print cycles.

Figure 4:
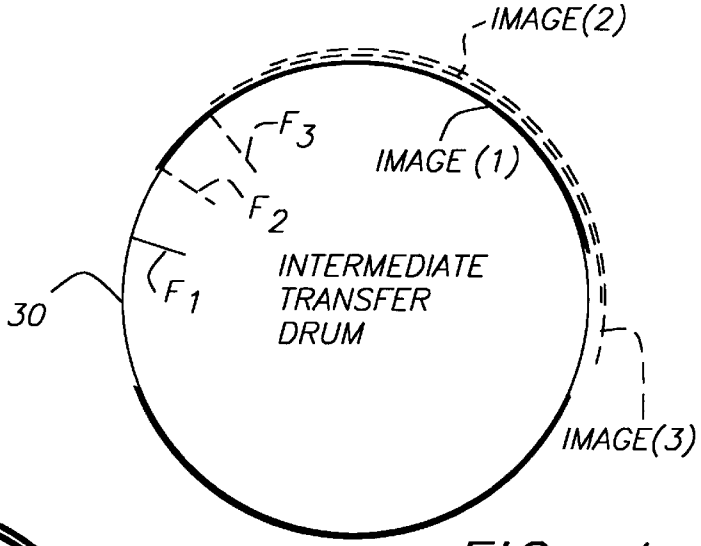
FIG. 4 is a schematic illustration of an intermediate transfer drum having a plurality of "start-of-image" flags so as to be able to accomplish image precession according to this invention.

The precession of the start of image location relative to a fixed position on the intermediate transfer drum 30 is accomplished, for example, by using a number of "start-of-image" flags $F_1$, $F_2$, $F_3$, etc., on the intermediate transfer drum 30 (see FIG. 4). The logic and control unit L for the reproduction apparatus 10 sequences through different image start locations by selecting a desired different one of the flags $F_1$, $F_2$, $F_3$, etc., to serve as the "start-of-image" flag. Of course according to this invention, there are other methods of implementing the image to intermediate transfer drum position precession. For example, the intermediate transfer drum may be driven by a stepper motor and the number of steps of the motor to "start-of-image" counted. Progressively different counts can be selected by the logic and control unit L to delay the start of imaging with respect to the detection of a single "start-of-image" flag by the sensor S.

The intermediate transfer drum 30 and the dielectric member 20, as shown in the illustrated configuration, are selected to have nearly identical diameters. This results in that there is a corresponding band on the dielectric member that is continuously contacted by the region of the intermediate transfer drum representing the interframe between images for the single "start-of-image" flag situation. The described method for substantially eliminating the fuser oil buildup (contamination) in such interframe region of the intermediate transfer drum (and thus the backup transfer roller and the dielectric member) has the greatest utility in a reproduction apparatus which has both a seamless dielectric member and a seamless transfer member. A seam in either of the members would limit, to at least some extent, the amount to which the image to transfer member position could be varied.

The invention has been described in detail with particular reference to preferred embodiment thereof, but it will be understood that variations and modifications can be effected within the spirit and scope of the invention as set forth in the claims.

What is claimed is:

1. In an electrostatographic reproduction apparatus capable of producing duplex copies, said reproduction apparatus including an intermediate transfer member for transferring a marking particle image from a member upon which such marking particle image is initially formed to said intermediate transfer member and thereafter from said intermediate transfer member to a receiver member, and a fuser assembly for fixing a transferred image on said receiver member, said fuser assembly including means for dispensing fuser oil to prevent offset of a marking particle image to said fuser assembly, a transfer control device for preventing fuser oil contamination defects on copies produced by such reproduction apparatus, said transfer control device comprising:

means for moving said intermediate transfer member and said member upon which a marking particle image is initially formed in timed relation to effect registered transfer of such marking particle image from said member to said intermediate transfer member, and means for adjusting the starting point for marking particle image transfer to said intermediate transfer member so as to cause such starting point to precess relative to a position on the surface of said intermediate transfer member.

2. The transfer control device of claim 1, wherein said starting point adjusting means includes a series of "start-of-image" flags spaced relative to said surface of said intermediate transfer member in the direction of movement thereof, and a sensor for detecting said flags and producing a signal indicative thereof.

3. The transfer control device of claim 2, wherein said starting point adjusting means further includes means for selecting in a desired order different "start-of-image" flags from said series of "start-of-image" flags, and utilizing said sensor to detect said selected flag.

4. The transfer control device of claim 1, wherein said intermediate transfer member has a continuous surface, and said starting point adjusting means includes a series of "start-of-image" flags spaced relative to said continuous surface in the direction of movement of said intermediate transfer member, and a sensor for detecting said flags and producing a signal indicative thereof.

5. The transfer control device of claim 1, wherein said moving means is a stepper motor and said intermediate transfer member is a drum adapted to be rotated about its longitudinal axis by said stepper motor, and said starting point adjusting means includes means for selecting a series of counts of different numbers of steps for said stepper motor, from a fixed location relative to said circumference of said drum prior to starting marking particle image transfer.

6. In an electrostatographic reproduction apparatus capable of producing duplex copies, where an intermediate transfer member is utilized for transferring a marking particle image from a member upon which such marking particle image is initially formed to said intermediate transfer member and thereafter from said intermediate transfer member to a receiver member, and a fuser assembly is utilized for fixing a transferred image on said receiver member, said fuser assembly including means for dispensing fuser oil to prevent offset of a marking particle image to said fuser assembly, a method for preventing fuser oil contamination defects on copies produced by such reproduction apparatus, said method comprising the steps of:

moving said intermediate transfer member and said member upon which a marking particle image is initially formed in timed relation to effect registered transfer of such marking particle image from said member to said intermediate transfer member, and adjusting the starting point for marking particle image transfer to said intermediate transfer member so as to causing such starting point to precess relative to a position on the surface of said intermediate transfer member.

7. The method for preventing fuser oil contamination defects of claim 6, wherein said adjusting said starting point includes the step of selecting different ones of a series of "start-of-image" flags spaced along said intermediate transfer member.

8. The method for preventing fuser oil contamination defects of claim 6, wherein said intermediate transfer member is a drum, and said adjusting said starting point includes the step of selecting different ones of a series of "start-of-image" flags spaced about the circumference of said drum.

9. The method for preventing fuser oil contamination defects of claim 6, wherein said rotating means is a stepper motor and said intermediate transfer member is a drum rotated about its longitudinal axis by said stepper motor, and said adjusting said starting point includes the step of selecting different ones of a series of counts of different numbers of steps for said stepper motor prior to starting marking particle image transfer.

* * * * *